US007323090B2

(12) United States Patent
Houda et al.

(10) Patent No.: US 7,323,090 B2
(45) Date of Patent: Jan. 29, 2008

(54) BIPOLAR ZERO-GAP TYPE ELECTROLYTIC CELL

(75) Inventors: Hiroyoshi Houda, Nobeoka (JP); Yasuhide Noaki, Kawasaki (JP)

(73) Assignee: Asahi Kasei Chemicals Corporation, Tokyo (JP)

( * ) Notice: Subject to any disclaimer, the term of this patent is extended or adjusted under 35 U.S.C. 154(b) by 414 days.

(21) Appl. No.: 10/535,249

(22) PCT Filed: Nov. 26, 2003

(86) PCT No.: PCT/JP03/15101

§ 371 (c)(1),
(2), (4) Date: May 18, 2005

(87) PCT Pub. No.: WO2004/048643

PCT Pub. Date: Jun. 10, 2004

(65) Prior Publication Data

US 2006/0042935 A1 Mar. 2, 2006

(30) Foreign Application Priority Data

Nov. 27, 2002 (JP) ..... 2002-344467

(51) Int. Cl.
*C25B 9/20* (2006.01)

(52) U.S. Cl. ..... 204/254; 204/255; 204/256; 204/258

(58) Field of Classification Search ..... 204/254, 204/255, 256, 258
See application file for complete search history.

(56) References Cited

U.S. PATENT DOCUMENTS 4,111,779 A * 9/1978 Seko et al. ..... 204/255
4,343,690 A * 8/1982 de Nora ..... 204/263
4,381,979 A 5/1983 De Nora et al.
4,444,632 A 4/1984 deNora
4,615,775 A 10/1986 de Nora et al.
4,687,558 A * 8/1987 Justice et al. ..... 205/516
4,792,388 A * 12/1988 de Nora ..... 205/525
5,225,060 A * 7/1993 Noaki et al. ..... 204/237
5,599,430 A 2/1997 Pimlott et al.
5,693,202 A * 12/1997 Gestermann et al. ..... 204/265
6,117,286 A * 9/2000 Shimamune et al. ..... 204/252
6,495,006 B1 * 12/2002 Kimura et al. ..... 204/254
6,773,561 B1 * 8/2004 Noaki et al. ..... 204/256
6,790,339 B2 * 9/2004 Bulan et al. ..... 205/620
7,083,708 B2 * 8/2006 Chlistunoff et al. ..... 204/252
7,229,536 B2 * 6/2007 Houda et al. ..... 204/291

(Continued)

FOREIGN PATENT DOCUMENTS

EP 0050373 4/1982

(Continued)

*Primary Examiner*—Bruce F. Bell
(74) *Attorney, Agent, or Firm*—Staas & Halsey LLP

(57) ABSTRACT

A bipolar zero-gap electrolytic cell comprising an anode comprising an anode substrate constituted of a titanium expanded metal or titanium metal net of 25 to 70% opening ratio, which anode after coating the substrate with a catalyst has a surface of 5 to 50 μm unevenness difference maximum and has a thickness of 0.7 to 2.0 mm. In this electrolytic cell, the possibility of breakage of ion exchange membrane is low, and the anolyte and catholyte have a concentration distribution falling within given range. With this electrolytic cell, stable electrolysis can be performed for a prolonged period of time with less variation of cell internal pressure.

6 Claims, 5 Drawing Sheets

U.S. PATENT DOCUMENTS

| | | | | |
|---|---|---|---|---|
| 2003/0047446 | A1* | 3/2003 | Gestermann et al. | 204/252 |
| 2003/0173211 | A1* | 9/2003 | Gestermann et al. | 204/265 |
| 2004/0188245 | A1* | 9/2004 | Katayama et al. | 204/252 |
| 2005/0000798 | A1* | 1/2005 | Faita et al. | 204/242 |
| 2005/0077068 | A1* | 4/2005 | Gestermann et al. | 174/50 |
| 2006/0231415 | A1* | 10/2006 | Christensen | 205/688 |

FOREIGN PATENT DOCUMENTS

| | | |
|---|---|---|
| EP | 00124125 | 11/1984 |
| JP | 51-43377 | 4/1976 |
| JP | 57-98682 | 6/1982 |
| JP | 59-153376 | 10/1984 |
| JP | 61-019789 | 1/1986 |
| JP | 61-500669 | 4/1986 |
| JP | 62-096688 | 5/1987 |
| JP | 63-011686 | 1/1988 |
| JP | 4-289184 | 10/1992 |
| JP | 5-34434 | 5/1993 |
| JP | 6-70276 | 9/1994 |
| JP | 8-100286 | 4/1996 |
| JP | 8-109490 | 4/1996 |
| JP | 10-053887 | 2/1998 |
| JP | 2876427 | 1/1999 |
| JP | 2000-178781 | 6/2000 |
| JP | 2000-178782 | 6/2000 |
| JP | 2001-064792 | 3/2001 |
| JP | 2001-152380 | 6/2001 |
| JP | 2001-262387 | 9/2001 |
| WO | WO85/2419 | 6/1985 |
| WO | WO01/16398 | 3/2001 |

* cited by examiner

BIPOLAR ZERO-GAP TYPE ELECTROLYTIC CELL

TECHNICAL FIELD

The present invention relates to a bipolar, zero-gap type electrolytic cell.

This is a bipolar electrolytic cell for use in a filter press type electrolyzer. The electrolyzer has many bipolar electrolytic cells arranged though the intermediary of cationic exchange membranes, each of which comprises an anode chamber and a cathode chamber arranged back to back. In the cathode chamber, there are at least two layers of a conductive cushion mat layer and a hydrogen generating cathode stacked over the cushion mat layer in an area where it contacts the cationic exchange membrane.

This electrolytic cell has an anode having a base material formed of a titanium expanded metal or titanium wire mesh with an open-area percentage of 25% to 70%. The surface of the anode, after the base material has been applied with a catalyst, has a maximum height difference of 5 μm to 50 μm between ridges and troughs. The anode is 0.7 mm to 2.0 mm thick.

BACKGROUND ART

Many proposals have been made on an ion exchange membrane type alkali chloride electrolytic cell for producing highly pure, alkaline metal hydroxides with a high current efficiency and a low voltage. Among them there are proposals concerning a zero-gap type in which an anode and a cathode are in contact with each other with an ion exchange membrane interposed therebetween.

U.S. Pat. No. 4,444,632, JP-B-6-70276 (corresponding to U.S. Pat. No. 4,615,775 and European Patent No. 124125) and JP-A-57-98682 (corresponding to JP-B-1-25836, U.S. Pat. No. 4,381,979 and European Patent No. 50373) have proposed electrolytic cells using wire mats. Japanese Patent No. 2876427 (corresponding to U.S. Pat. No. 5,599,430) has proposed a mattress for an electrochemical bath.

Some of these patents have an expanded pressure plate and a cathode fine mesh screen. In these electrolytic cells, however, the mat strength, anode shape, electrolyte concentration distribution or in-cell pressure variations are not appropriate, which in turn gives rise to problems of an undesirable increase in voltage and breakage of the ion exchange membrane.

JP-B-5-34434, JP-A-2000-178781, JP-A-2000-178782, JP-A-2001-64792, JP-A-2001-152380 and JP-A-2001-262387 disclose elastic mats and the strength thereof. These references also disclose the strength of cathodes and a way to prevent collapse of the mats.

These improvements are effective. However, at a high current density of more than 5 kA/m$^2$, the improvements are not enough for electrolysis with a stable long-term current efficiency and voltage.

Other zero-gap electrolytic cells use springs. For example, JP-A-10-53887 discloses an electrolyzer using a spring. However, the spring increases pressure in local areas and may cause damages to a membrane in contact with it. Electrolyzers that can employ the zero-gap structure are shown in, for instance, JP-A-51-43377, JP-A-62-96688 and JP-A-61-500669 (corresponding to WO85/2419).

These unit electrolytic cells have no air-liquid separation chamber formed within them and extract gas and liquid upwardly as is in an air-liquid mixed phase. This causes vibrations in the unit electrolytic cells and gives rise to a problem of possible breakage of the ion exchange membrane. Further, they have no provisions inside for mixing electrolyte and have a problem that a large volume of electrolyte has to be circulated to evenly distribute the electrolyte within the electrolytic chamber.

JP-A-61-19789 and JP-A-63-11686 disclose a way to extract gas and electrolyte downwardly rather than upwardly. However, gas and liquid may in some cases be drawn out in a mixed phase, making it impossible to prevent vibrations inside unit electrolytic cells. Further, a conductive dispersion member or current distribution member intended for internal circulation of the electrolyte is provided to make electrolyte concentration uniform in the cells, but this has a drawback of making the electrolyte cell structure complex.

JP-U-59-153376 discloses a wave elimination plate as a countermeasure for preventing vibrations in an electrolytic cell. This alone, however, can not provide enough wave elimination effect, and it is impossible to completely eliminate vibrations caused by pressure variations in the electrolytic cell.

JP-A-4-289184 and JP-A-8-100286 disclose a cylindrical duct and a downcomer for internally circulating an electrolyte to make the electrolyte concentration uniform in the cells. This, however, makes the structure in the electrolytic cells complex and increases the manufacturing costs. Further, for electrolysis at a high current density of more than 5 kA/m$^2$, the electrolyte concentration distribution is still large enough to have possible adverse effects on the ion exchange membrane.

Furthermore, although these publications attempt to prevent vibrations by (1) providing an air-liquid separation chamber having a relatively large volume and by (2) extracting gas and liquid in a separated state downwardly or horizontally, vibrations may still occur in some cases at a high current density of more than 5 kA/m$^2$.

DISCLOSURE OF INVENTION

The invention has an object of providing a bipolar zero-gap type electrolytic cell and an electrolysis method that enable stable electrolysis at a high current density with a simple and reliable structure.

More specifically, the object of the invention is to provide a bipolar zero-gap type electrolytic cell, which has a zero-gap structure with a sturdy ion exchange membrane that rarely breaks, in which anode liquid and cathode liquid have a predetermined range of concentration distribution. It is a goal to allow electrolysis with decreased in-cell pressure variations and therefore increased long-term stability when performing electrolysis at a high current density of more than 4 kA/m$^2$ with use of a zero-gap ion exchange membrane type electrolyzer. It is a further goal to provide an electrolysis method for the cell.

Another object of the invention is to provide a bipolar zero-gap type electrolytic cell that enables electrolysis with long-term stability by preventing possible damage of an ion exchange membrane caused by gas vibrations in the electrolytic cell.

This invention provides a bipolar, zero-gap type electrolytic cell which electrolyzes an alkali chloride water solution by using a cationic ion exchange membrane. More specifically, the bipolar, zero-gap type electrolytic cell is intended for use in a filter press type electrolyzer which has a plurality of bipolar electrolytic cells and a plurality of cationic exchange membranes each disposed between the adjoining bipolar electrolytic cells.

This cell is characterized by an anode chamber, an anode installed in the anode chamber, a cathode chamber arranged back to back with the anode chamber, and a cathode having at least two stacked layers in the cathode chamber. The anode is formed of an anode base material including a titanium expanded metal or titanium wire net with an opening percentage of 25-75%. After a catalyst is applied to the anode base material, the anode has a maximum height difference of 5-50 μm between its surface irregularities and a thickness of 0.7-2.0 mm. The layers of the cathode include a conductive cushion mat layer and a hydrogen generating cathode layer. The hydrogen generating cathode layer adjoins the cushion mat layer and is arranged in an area where it contacts the cationic exchange membrane.

This construction maintains an appropriate zero-gap between the anode, the cationic exchange membrane and the cathode, allows generated gas to pass through, and thereby makes it possible to minimize damage to the ion exchange membrane and in-cell pressure variations and carry out stable electrolysis for a long term.

The anode base material includes the titanium expanded metal, which is preferably formed by expanding a titanium plate and then roll-pressing it. The thickness of the expanded metal is preferably set to 95-105% of its thickness before expansion by the roll-pressing.

The hydrogen generating cathode is formed of a base material which has a thickness of 0.05-0.5 mm and is chosen from a group of a nickel wire net, a nickel expanded metal and a stamped, porous nickel plate. The hydrogen generating cathode preferably has an electrolysis catalyst coating layer which is formed on the hydrogen generating cathode and has a thickness of 50 μm or less.

With this construction it is possible to easily manufacture the electrodes at a low cost, which have appropriate flexibility and therefore hardly damage the ion exchange membrane.

The electrolytic cell may include gas-liquid separation chambers formed integrally with non-current-carrying portions at tops of the anode chamber and cathode chamber. In this case, at least one of a cylindrical duct and a baffle plate that serve as an internal circulation path for electrolyte is preferably provided between a separation wall of at least one of the anode and cathode chambers and the associated electrode.

The gas-liquid separation chambers are preferably formed with separation plates.

The gas-liquid separation chambers are installed by extracting generated gas from the tops of the electrode chambers, thereby preventing gas vibrations and allowing more stable electrolysis.

BEST MODE FOR CARRYING OUT THE INVENTION

Figure 1:
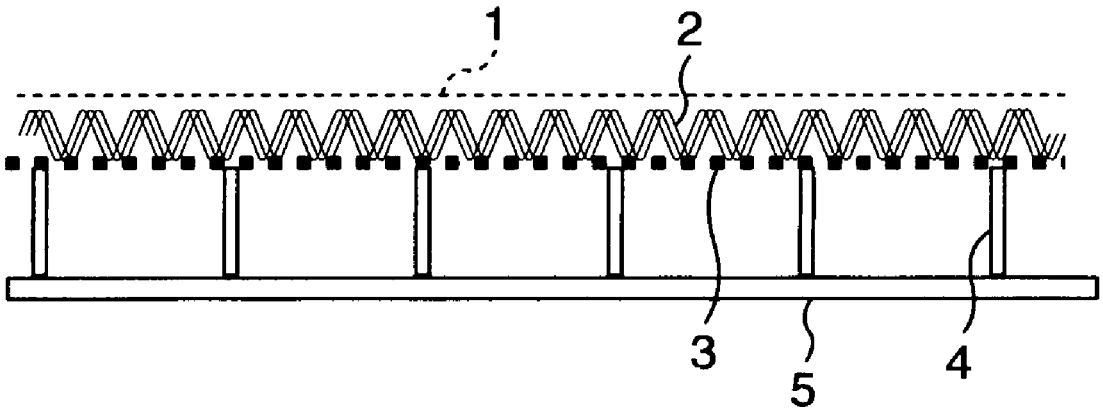
FIG. 1 is a side view showing an example of a cathode that may be used in the bipolar, zero-gap type electrolytic cell of the invention.

Generally, what are required for performing stable electrolysis of alkali chlorides and producing chlorine, hydrogen and caustic soda at a low cost are a low facility cost, an ability to electrolyze at low voltage, an ion exchange membrane hardly damaged by vibrations in a cell or like, uniform distribution of electrolyte concentration in the cell and stability of ion exchange membrane voltage and current efficiency, etc.

To meet these requirements, alkali chloride electrolysis based on an ion exchange membrane method has remarkably been improved in performance in recent years. Particularly notable are the performance improvements of ion exchange membranes, electrodes and unit electrolytic cells. For example, an electric power consumption rate for the ion exchange membrane method has decreased to 2000 kW/NaOH-t for 4 kA/m$^2$ or less in recent years, down from the 3000 kW/NaOH-t that was required when the ion exchange membrane process became available.

However, with the recent increased demands for large facilities, reduced energy consumption and higher efficiency, it is desired not only to enable electrolysis at an electrolysis current density of 4-8 kA/m$^2$ even in the electrolytic cells up from the initial 3 kA/m$^2$, but also to minimize a cell voltage.

Under these circumstances, the present inventors have considered improving unit electrolytic cells in an effort to realize stable electrolysis that can be performed by using a high current density of 4-8 kA/m$^2$ at a significantly lower voltage than that of the conventional electrolytic cells.

Ordinarily, a cationic exchange membrane is pressed against the anode by a pressure from the cathode chamber, and there is a gap formed between the cathode and the cationic exchange membrane. In this gap a large number of bubbles as well as electrolyte exist and therefore its electric resistance is very high. For significantly reducing electrolytic cell voltage, it is most effective to make a distance between the anode and the cathode (hereinafter referred to as an electrode distance) as small as possible to eliminate influences of the electrolyte and gas bubbles present between the anode and the cathode.

Conventionally, the electrode distance is normally 1-3 mm (hereinafter referred to as a finite gap). Some means have already been proposed to minimize the electrode distance.

However, the electrolytic cells generally have a conduction area of more than 2 $m^2$, and it is impossible to make the anode and the cathode completely flat and smooth and set the tolerance of manufacturing precision to almost zero mm. Therefore, simply reducing the electrode distance cannot achieve an ideal zero-gap state, since the ion exchange membrane installed between the anode and the cathode is broken by pressing and cutting, or since the electrode distance is almost equal to the thickness of the ion exchange membrane and there are portions between the anode and the membrane and between the cathode and the membrane, which can not be kept in a an almost no gap state (hereinafter referred to as zero-gap).

In the ion exchange membrane, the anode has a construction of relatively high rigidity to reduce deformation even when being pressed by the ion exchange membrane, and only the cathode side is made of a flexible construction for absorbing irregularities caused by the manufacturing precision tolerance of electrolytic cells, the deformations of electrodes and so forth to thereby keep the zero-gap state.

The zero-gap structure is required to have at least two stacked layers of a conductive cushion mat on the cathode side and a hydrogen generating cathode adjoining the cushion mat and placed in an area that contacts the cationic exchange membrane. For example, it preferably has at least three layers, as shown in FIG. 1, in which a conductive plate 3 is installed in the cathode chamber, a conductive cushion mat 2 is stacked on the conductive plate, and a hydrogen generating cathode 1 having a thickness of 0.5 mm or less is stacked on the conductive cushion mat in an area where it contacts with the cationic exchange membrane.

The conductive plate 3 serves to transmit electricity to the cushion mat 2 and the hydrogen generating cathode 1, both stacked over the conductive plate 3, to support the weight of these members and to pass the gas generated from the cathode toward a separation wall 5 side smoothly. Thus, the conductive plate is preferably formed of such materials as expanded metal and stamped porous plate. An opening percentage is preferably more than 40% to allow the hydrogen gas generated from the cathode to be extracted toward the separation wall side. As for the strength, when the interval between ribs 4 is 100 mm, the conductive plate can perform its function, if a pressure of 3 m-$H_2O$ is applied to the center of the plate, as long as its deflection is less than 0.5 mm. As for the material, nickel, nickel alloy, stainless steel and iron may be used from the standpoint of corrosion resistance. In terms of conductivity, nickel is most preferable.

Figure 2:
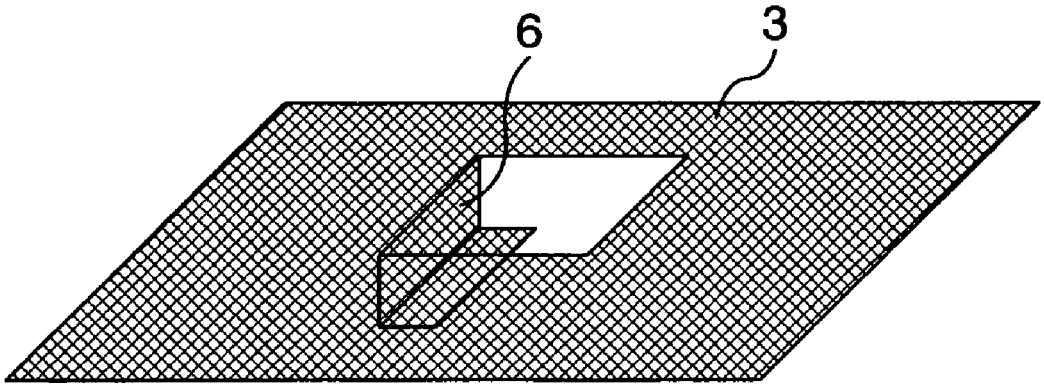
FIG. 2 is a perspective view showing a L-shaped portion in an example of a conductive plate applicable to the invention.

The conductive plate 3 may be formed with an L-shaped portion 6, as shown in FIG. 2, and be directly attached to the separation wall 5. In that case, the L-shaped portion serves both as the rib and the conductive plate and advantageously allows saving of material and reduction of the assembly time.

For the conductive plate, it is possible to use the cathode as is, which has been used in the finite gap electrolytic cell.

The cushion mat has to rest between the conductive plate and the hydrogen generating cathode and transmit electricity to the cathode and to smoothly pass the hydrogen gas generated from the cathode to the conductive plate side. The most important role is to apply to the cathode in contact with the ion exchange membrane uniform pressure at a level that will not damage the membrane in order to keep the cathode in intimate contact with the ion exchange membrane.

As for the cushion mat, a commonly known cushion mat may be used. A wire diameter of 0.05-0.25 mm is preferably used for the cushion mat. If the wire diameter is less than 0.05 mm, the cushion mat may easily collapse. If the wire diameter is larger than 0.25 mm, the cushion mat becomes strong and, when used for electrolysis, this may adversely affect the performance of the membrane because of the increased pressing force.

More preferably, a wire diameter in a range of 0.08-0.15 mm may be used. For example, nickel wires of about 0.1 mm diameter may be woven and then corrugated. As for the material, nickel is ordinarily used because of its high conductivity. A thickness of 3-15 mm may be used for the cushion mat.

Even more preferably, a thickness of 5-10 mm may be used. Flexibility of the cushion mat may be in the known range. For example, the flexibility of the cushion mat may be such that a repulsive force when the mat is compressed by 50% is in the range of 20-400 g/$cm^2$. Repulsive force smaller than 20 g/$cm^2$ during the 50% compression is not preferable, since it cannot completely press the membrane, and a repulsive force greater than 400 g/$cm^2$ is also not preferred, since it presses the membrane too strongly.

More preferably, it is possible to use a mat having an elasticity such that the repulsive force during the 50% compressive deformation is 30-200 g/$cm^2$.

Such a cushion mat is stacked on the conductive plate for operation. Commonly known methods may be used for this installation, for instance the cushion mat is fixed by spot welding or by resin pins or metal wires.

The cathode may be stacked directly on the cushion mat. Alternatively, it may be stacked through a separate conductive sheet. Preferably, the cathode used in the zero-gap structure has a small wire diameter and a small number of meshes because such a cathode has good flexibility. The cathode may be formed of a commonly available base material having a wire diameter of 0.1-0.5 mm and sieve opening of 20-80 meshes.

For the base material of the cathode, it is also preferable to use a nickel expanded metal, a stamped nickel porous metal and a nickel wire net, which have a thickness of 0.05-0.5 mm and an opening percentage of 20-70%.

Considering handling of the cathode during the manufacturing process and its flexibility, it is preferable to use a nickel expanded metal, a nickel stamped porous plate or a nickel wire net with a thickness of 0.1-0.2 mm and an opening percentage of 25-65%. In the case of the nickel expanded metal, it is preferable to roll the expanded metal to flatten it to a thickness range of 95-105% of the thickness before flattening. In the case of the wire net, two lines cross each other at a right angle, and the plate thickness is two times the wire diameter. It is also preferable to roll the wire net in a thickness range of 95-105% of the wire diameter.

The cathode is preferably coated with a thin layer of a precious metal oxide. The reason for this is as follows. A coating formed by plasma-spraying of nickel oxide has a thickness of 100 μm or more and is hard and brittle for the zero-gap electrode which requires flexibility, and an ion exchange membrane in contact with the cathode may easily be damaged. Further, with a metal plating, a sufficient level of activity is hard to obtain. Therefore, the coating made mainly of a precious metal oxide is preferable since it is highly active and can make the coating layer thin.

A small thickness of the coating layer is preferred as it keeps the cathode base material flexible and therefore protects the ion exchange membrane from damage. If the coating is thicker, manufacturing cost is increased and the coating may damage the ion exchange membrane. However, if the coating is too thin, it may not provide sufficient activity. Thus, a coating layer thickness is preferably from 0.5 μm to 50 μm, more preferably in a range between 1 μm and 10 μm. The coating thickness of the cathode can be measured by cutting the base material and using an optical microscope or electronic microscope.

Such a cathode can be mounted using a commonly known welding technique or pins.

In the zero-gap electrolytic cell, in addition to the requirements described above, the geometry of the anode itself is also important. The ion exchange membrane is pushed against the anode with more force stronger than in the conventional finite gap electrolytic cell, and if the anode is made of an expanded metal base material, the ion exchange membrane may be damaged at the end of an opening or it may cut into the opening so that a gap is formed between the cathode and the ion exchange membrane and the voltage is increased.

The electrode therefore has to be formed as planar as possible. For that purpose, it is preferable to press the expanded base material with a roller and form it in a planar shape. Generally, the expanding process increases the apparent thickness to about 1.5 to 2 times the thickness before the processing. Using the expanded material as is for the zero-gap electrolytic cell causes the aforementioned problems and thus the expanded material is preferably rolled by a roll press to be planarized and to reduce its thickness to 95-105% of the thickness of the metal plate before the processing. This may prevent damage to the ion exchange membrane and unexpectedly reduce the voltage. The reason for this is not entirely clear. However, it is believed that when the surface of the ion exchange membrane and the electrode surface are uniform, there is intimate contact and the current density becomes uniform.

The thickness of the anode is preferably from 0.7 mm to 2.0 mm in an ordinary case. Too small a thickness will cause the anode to sink by the pressure of the ion exchange membrane pushing the anode, which is caused by a pressure difference between the anode chamber and the cathode chamber and by the pressing force of the cathode. This widens the electrode distance, increases the voltage of the zero-gap electrolytic cell and therefore is not desirable. On the other hand, too large a thickness will cause an electrochemical reaction on the back of the electrode, i.e., on the side opposite its surface in contact with the ion exchange membrane, thus increasing the resistance and is not desirable.

A more preferred thickness of the anode is between 0.9 mm and 1.5 mm and even more preferably between 0.9 mm and 1.1 mm. In the case of the metal wire net, two wires cross each other at a right angle, and the thickness is two times the wire diameter.

In the zero-gap electrolytic cell, the ion exchange membrane and the electrode surface are in intimate contact during electrolysis, and the supply of the electrolyte may locally become short. In the zero-gap electrolytic cell, chlorine gas is produced on the anode side during electrolysis and hydrogen gas is provided on the cathode side. Normally, the electrolysis operation is performed by maintaining the gas pressure on the cathode side higher than the gas pressure on the anode side and pressing the membrane against the anode by the gas pressure difference. In the zero-gap electrolyzer, the pressing force is applied to the anode side also from the mattress on the cathode side during the operation, so that the pressure acting on the anode side is higher than the pressure in the finite gap electrolyzer that normally has a gap between the anode and the cathode. As the pressing force becomes large, fine bubbles may form in the ion exchange membrane or the electrolytic voltage may increase.

To prevent these problems, the anode preferably has irregularities formed in the anode surface such that electrolyte feeding is facilitated though the irregularities. More specifically, it is effective to form appropriate irregularities in the anode surface by blasting or acid etching.

The irregularities are applied with an anode catalyst, which fills the recesses and makes the surface less-rough than it was immediately after etching. For example, the anode catalyst is formed by acid-treating the surface of the titanium base material, applying to the surface a mixed solution of iridium chloride, ruthenium chloride and titanium chloride, and then thermally decomposing the solution. By repeating the process of applying the catalyst to a thickness of 0.2-0.3 μm and thermally decomposing the catalyst, a catalyst layer can be formed to a total thickness of 1-10 μm on average. While the thickness of the catalyst layer is determined in view of the lifetime and the price of the anode, it is preferably selected in the range of between 1 μm and 3 μm on average.

As for the surface roughness after the anode catalyst application, it is required that a maximum difference between ridges and troughs on the surface is in a range of between 5 μm and 50 μm. When the irregularities are too small, the supply of electrolyte may become insufficient in certain locations, and this is not desirable. When the irregularities are too large, the surface of the ion exchange membrane may be damaged, and this is undesirable as well. Therefore, for stable use of the ion exchange membrane, the maximum height difference between ridges and troughs in the anode surface needs to fall in the range of between 5 μm and 50 μm. For more stable operation, it is further preferred that the maximum height difference of the irregularities on the anode surface be in the range from 8 μm to 30 μm.

Either a contact type measuring method using a probe or a non-contact type measuring method using optical interference and laser light can be used to measure the surface roughness of the anode. After having undergone the expanding process, rolling process, acid processing and catalyst application, the anode will have fine irregularities in its surface that cannot be detected with a probe. So, the non-contact type measuring method is preferred.

The measurement using the non-contact type optical interference method may use the NewView5022 scanner from Zygo or a different device. The Zygo device has an optical microscope and an interference type object lens/CCD camera. The device three-dimensionally measures the surface geometry of a target and calculates the irregularities by irradiating a white light against the target and vertically scanning interference fringes that form according to the surface geometry.

Although the area to be measured can be selected arbitrarily, it is preferable to measure an area of 10-300 $\mu m^2$ in order to properly know the irregularities of the anode surface. Particularly when measuring an expanded metal, it is more preferable to measure an area of 50-150 $\mu m^2$.

While measurements, such as average surface roughness Ra, and the 10-point average surface roughness, can be taken, a difference between the maximum height value and the minimum height value of surface irregularities is calculated as a PV (peak-to-valley) value. The inventors have found a significant correlation between the anode surface roughness as represented by the PV value and test results using the zero-gap electrolyzer, and have achieved the present invention. In the following description, the PV value means the maximum height difference of irregularities on the anode surface.

The opening percentage of the anode base material is preferably set in a range of 25-70%. There are a variety of methods for measuring the opening percentage. Measurement may be made by any of them, for instance by a method of copying an electrode sample by a copying machine, cutting out opening portions and calculating a weight or by a method of measuring the length and width of opening portions and calculating the percentage.

If the opening percentage is too small, the supply of electrolyte to the ion exchange membrane may become insufficient, resulting in generation of bubbles, which in turn gives rise to a possibility that the electrolyzer may not be operated with stable voltage and current efficiency, and this is not desirable. If the opening percentage is too large, on the other hand, the surface area of the electrode decreases and the voltage increases, which is undesirable. Thus, the most preferred opening percentage is in a range of 30-60%.

For performing electrolysis by using a zero-gap electrolytic cell, according to the study by the inventors, the most preferable method includes the use of the bipolar, zero-gap type electrolytic cell having at least one cylindrical duct or baffle plate that forms an internal circulation path for the electrolyte, between a separation wall of the anode chamber and/or cathode chamber and the electrode. This cell has at least three layers on the cathode side, which are a conductive plate layer, a conductive cushion mat layer stacked on the conductive plate layer and a hydrogen generating cathode layer of a 0.5 mm or less thickness, stacked on the cushion mat layer in an area where it contacts the cationic exchange membrane. In such a zero-gap electrolytic cell, the electrolyte concentration distribution on the anode side and on the cathode side can be adjusted easily and properly. Further, in-cell pressure variations are small and the ion exchange membrane is almost free from damages. Therefore stable electrolysis can be performed for a long period of time even at a high current density of about 8 kA/m$^2$.

What is required to operate the zero-gap electrolyzer at stable current efficiency and stable voltage with a high current density of 4-8 kA/m$^2$, more preferably 5-8 kA/m$^2$, for a long period is that the electrolyte concentration distribution in the cell is uniform, that no stagnant bubbles or gas stay in the cell, and that, when the electrolyte, bubbles and gas are discharged from a discharge nozzle, they do not form a mixture of different phases. These provisions prevent pressure variations and therefore vibrations from occurring in the cell. Vibrations in the cell are measured by using an AR1200 analyzing recorder from Yokogawa Denki, which measures pressure variations in the anode cell and by taking a difference between the maximum pressure and the minimum pressure as the vibrations in the electrolyzer.

In the zero-gap cell, the anode and the cathode are held in intimate contact with each other through the ion exchange membrane. The movement of substance toward the ion exchange membrane can be easily obstructed. When the substance movement to the ion exchange membrane is impeded, various undesired influences, such as bubbles being formed in the ion exchange membrane, a voltage rise and a degraded current efficiency occur. It is therefore important to facilitate the substance movement to the ion exchange membrane to keep the electrolyte concentration distribution in the cell uniform.

The study of the inventors has revealed that there is a correlation between the concentration distribution on the anode side and a tendency for the current efficiency of the ion exchange membrane to deteriorate, and that the reduction in current efficiency becomes large as the concentration distribution widens. This tendency is particularly marked when the current density is high and when the gap is zero. Measurements were made of the electrolyte concentration at nine sampling positions 13 in the anode chamber as shown with black dots in FIG. 3, and the concentration difference was obtained by subtracting the minimum concentration from the maximum concentration. It has been found that, in the current density range of 4-8 kA/m$^2$, the current efficiency reduction is significant when the concentration difference is greater than 0.5 N. Therefore, in the zero-gap electrolyzer, for the current density of 4-8 kA/m$^2$ it is preferable to set the brine concentration difference to be less than 0.5 N.

Generally, the anode side of a chlor-alkali electrolyzer is greatly affected by bubbles. For example, under the electrolysis conditions of 4 kA/m$^2$, 0.1 MPa and 90° C., an upper part of the anode chamber is filled with bubbles and there are regions where a gas/liquid ratio is more than 80%. In areas with such a high gas-liquid ratio, when the current density increases, the electrolyte concentration distribution or difference tends to widen. The areas of a high gas-liquid ratio have low fluidity and therefore may cause locally a reduced electrolyte concentration and stagnancy of gas. To reduce a space with a large gas-liquid ratio in the upper part of the electrode chamber, currently available are methods that increase the electrolytic pressure and that greatly increase the circulating volume of electrolyte. These methods, however, have safety problems and tend to increase the facility building cost and are not desirable. With a high current density of more than 4 kA/m$^2$, the influence of bubbles significantly increases as the volume of gas produced increases, and there are cases where some areas in the cell are insufficiently agitated, a salt water consumption in the anode chamber is accelerated, and the electrolyte concentration distribution in the electrolytic cell becomes nonuniform.

There are some measures available in the zero-gap cell to prevent such electrolyte concentration distribution deterioration in the anode chamber and not to impede substance movement to the ion exchange membrane. For example, such an anode side construction as shown in FIG. 3 and FIG. 4 is appropriate for the zero-gap cell, that has a plate for internal circulation in the cell to allow uniform supply of electrolyte in a lateral direction.

Figure 3:
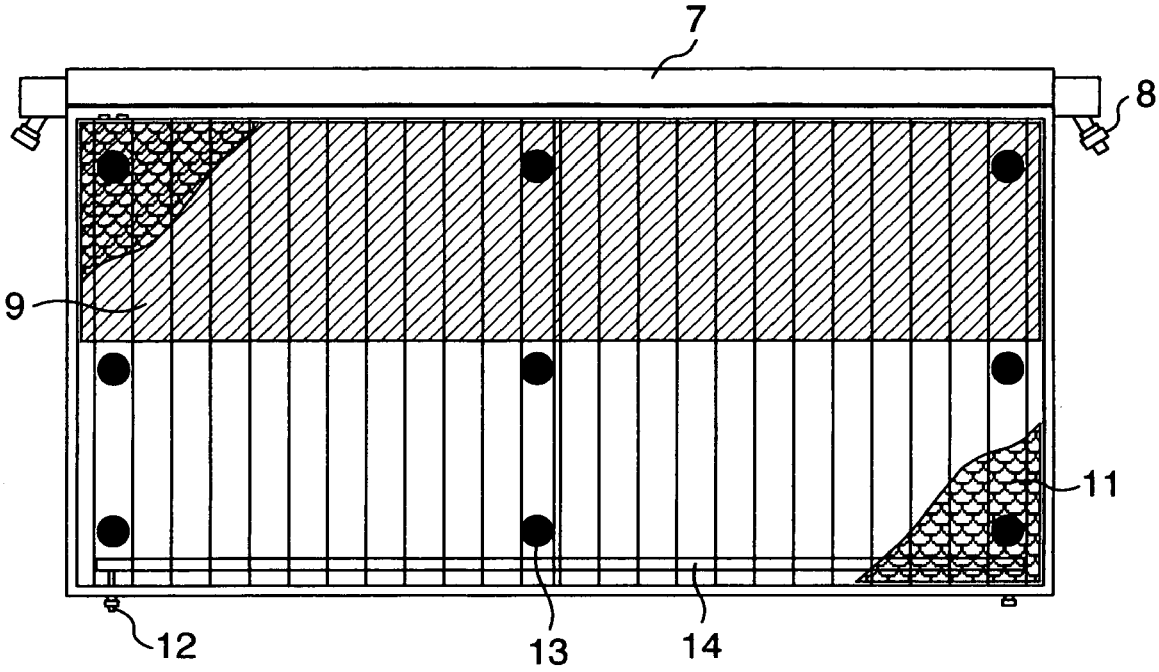
FIG. 3 is a plan view showing an example of an anode that may be used in the bipolar, zero-gap type electrolytic cell of the invention, and showing sampling positions of electrolyte concentration.
Figure 4:
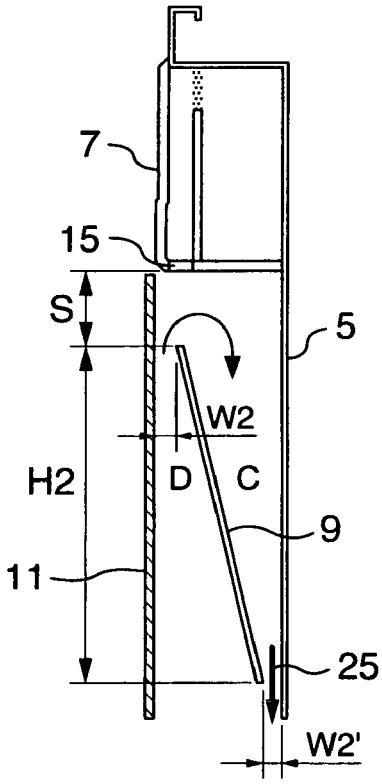
FIG. 4 is a sectional side view showing an example of an anode chamber that may be used in the bipolar, zero-gap type electrolytic cell of the invention.

More specifically, as shown in FIG. 3 and FIG. 4, saturated salt water supplied uniformly in the lateral direction through an anode liquid distributor 14 is circulated vertically in the cell by a baffle plate 9 to provide uniform electrolyte concentration distribution in the whole cell. Using this electrolytic cell, the electrolyte concentration distribution can be adjusted more precisely by collecting lean salt water discharged from an outlet nozzle 8 and mixing it with the saturated salt water to increase the volume of salt water and lower its concentration for re-supply. This enables the zero-gap electrolytic cell to perform electrolysis with a stable performance.

Figure 8:
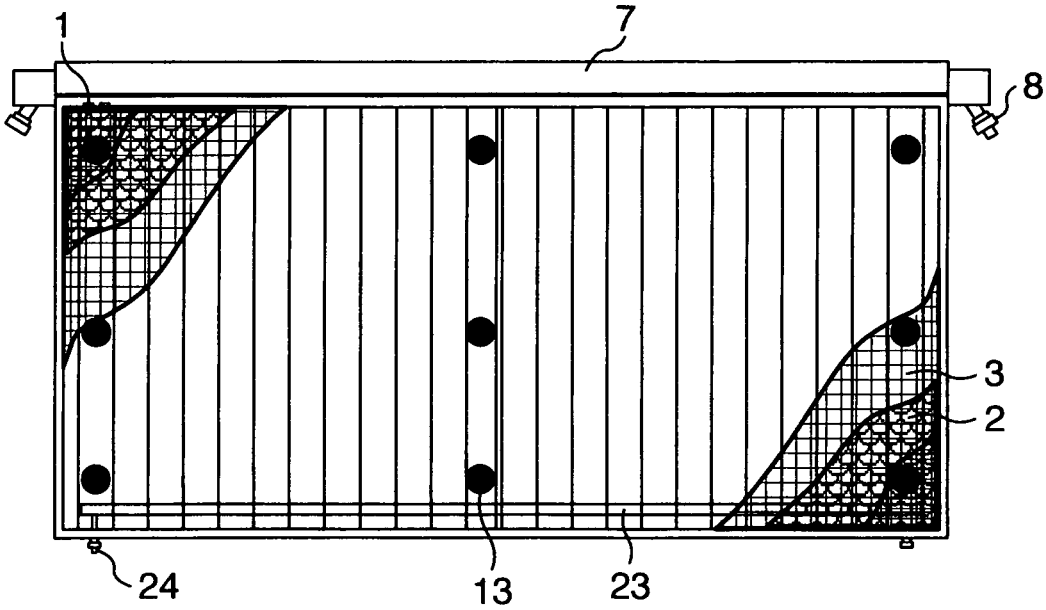
FIG. 8 is a plan view showing an example of a cathode that may be used in the bipolar, zero-gap type electrolytic cell of the invention, and showing sampling positions of electrolyte concentration.

The electrolyte concentration distribution on the cathode side correlates with a tendency for the ion exchange membrane voltage to rise. It has been found that the voltage increase becomes large as the electrolyte concentration distribution or difference widens. For a high current density, this tendency becomes significant particularly when the gap is zero. Also in the cathode chamber, as shown in FIG. 8, the electrolyte concentration was measured at nine sampling positions 13, as in the case with the anode chamber, and a concentration difference obtained by subtracting the minimum concentration from the maximum concentration. It was found that, in the current density range of 4-8 kA/m$^2$, the current efficiency decreased significantly when the concentration difference was greater than 2%. Therefore, in the zero-gap electrolyzer, for the current density of 4-8 kA/m$^2$ it is preferable to set the alkaline concentration difference to be less than 2%.

Figure 6:
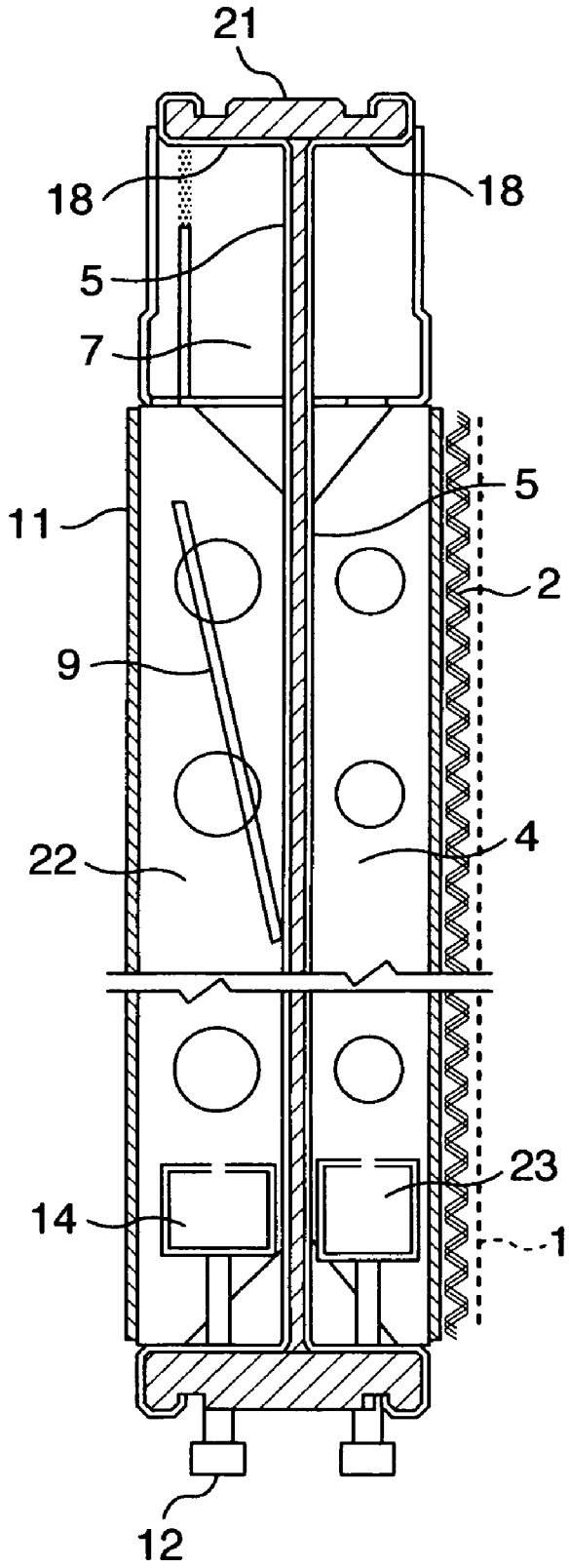
FIG. 6 is a sectional view of the bipolar, zero-gap type electrolytic cell according to an embodiment of the invention.

There are some measures available in the zero-gap cell to prevent deterioration of the electrolyte concentration distribution in the cathode chamber and to not impede substance movement near the ion exchange membrane. For example, such a cathode side construction as shown in FIG. 6 and FIG. 8 is an appropriate construction for the zero-gap cell, which allows uniform supply of electrolyte in a lateral direction.

More specifically, as shown in FIG. 8, the electrolyte supplied uniformly in the lateral direction through a cathode liquid distributor 23 is circulated vertically in the cell according to a concentration difference between the alkali supplied and the alkali in the cathode chamber in order to provide uniform electrolyte concentration distribution in the whole cell. Using this electrolytic cell, the electrolyte density distribution can be adjusted more precisely by properly adjusting the alkali flow being supplied. This enables the zero-gap electrolytic cell to perform electrolysis at a stable voltage.

When a pressure variation occurs in the electrolytic cell, a pressure difference between the anode chamber and the cathode chamber varies. In the zero-gap electrolytic cell, the cushion mat is used to keep the anode and the cathode in intimate contact with each other through the ion exchange membrane at all times. If the pressure difference varies, the force for the intimate contact also varies, with the result that the ion exchange membrane may be rubbed by the electrodes. The ion exchange membrane is made of resin and its surfaces are coated to prevent the adhesion of gas, so if the ion exchange membrane is rubbed by the electrodes, the coating layer on the ion exchange membrane may be scraped off or the ion exchange membrane itself may be chipped off. In that case, a voltage increase and deterioration of current efficiency will result, thus making stable electrolysis impossible. Therefore, preventing a pressure variation in the electrolytic cell is an important factor for the zero-gap electrolytic cell. Such a pressure variation in the cell is preferably kept as small as possible, e.g., to less than 30 cm-$H_2O$ or more preferably to less than 15 cm-$H_2O$, or most preferably to less than 10 cm-$H_2O$. If the pressure variation is smaller than 10 cm-$H_2O$, the ion exchange membrane will have no damage and can be put in continued operation even after a long-term electrolysis operation of more than one year.

Figure 5:
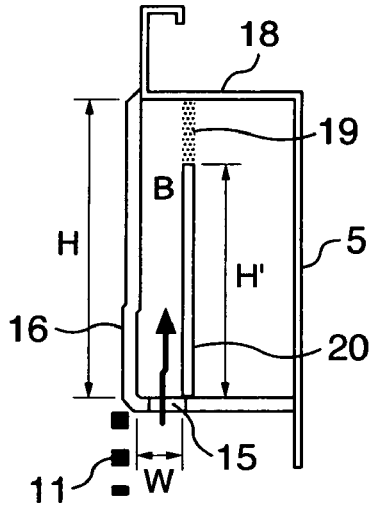
FIG. 5 is a sectional side view showing an anode side gas-liquid separation chamber that may be used in the bipolar, zero-gap type electrolytic cell of the invention.

Some measures are available to prevent pressure variations in the cell. For example, as shown in FIG. 5, it is effective to provide a partition plate 20 in a gas-liquid separation chamber 7 and also a bubble removing porous plate 19 on the top of the partition plate 20.

Embodiments of the invention and their applications will now be described. The present invention, however, is not limited to these specific forms.

APPLICATION EXAMPLE 1

Figure 7:
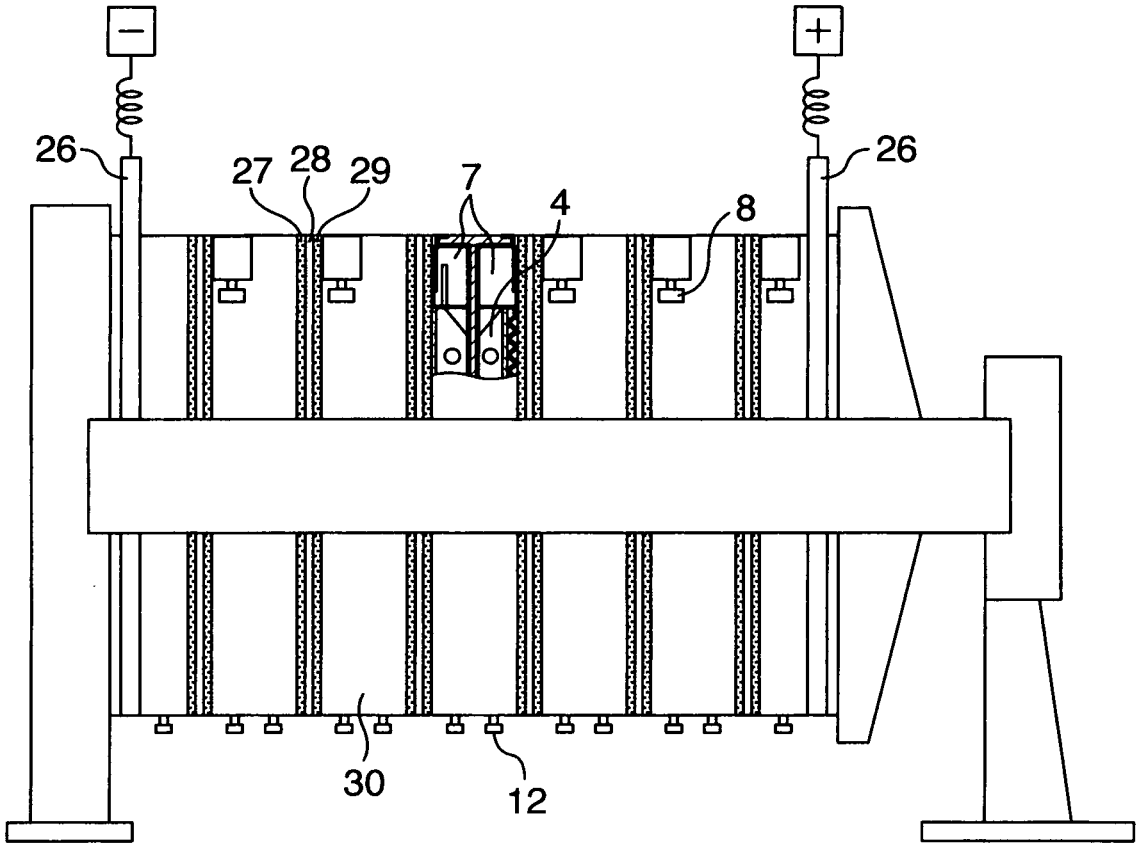
FIG. 7 is a partly cutaway assembly drawing showing an application of the electrolyzer using the cell of the invention, in which an ion exchange membrane 28, the anode chamber and a cathode chamber are fixed with a cathode gasket 27 and an anode gasket 28 respectively interposed therebetween.

The bipolar, zero-gap type electrolytic cells 30 according to an embodiment of the invention, each of which has an anode structure and a cathode structure similar to those of FIG. 3 and FIG. 8 and a cross-sectional structure similar to that shown in FIG. 6, are arranged in series and assembled into an electrolyzer as shown in FIG. 7. FIG. 7 shows an anode unit cell disposed at one end of the assembly and a cathode unit cell disposed at the other end and with current lead plates 28 attached as shown.

The bipolar, zero-gap type electrolytic cell 30 measures 2400 mm wide by 1280 mm high and has an anode chamber, a cathode chamber and a gas-liquid separation chamber 7. The anode chamber and the cathode chamber are each formed by a flat pan-shaped separation wall 5 and are arranged back to back. These anode chamber and cathode chamber are combined together by inserting a frame member 22 into a bent portion 18 provided at the top of the separation wall 5. Each gas-liquid separation chamber is defined in the upper part of each electrode chamber by fixing an L-shaped partition member 16 of a height H to the separation wall 5.

The gas-liquid separation chamber on the anode side has a cross-sectional area of 27 cm$^2$, on the cathode side has a cross-sectional area of 15 cm$^2$, and only the gas-liquid separation chamber on the anode side has a similar construction to that shown in FIG. 5. That is, in the gas-liquid separation chamber on the anode side is installed a titanium partition plate 20 having a height H' of 50 mm and a thickness of 1 mm, with a width W of a passage B set to 5 mm. On the top of the partition plate a titanium expanded metal porous plate 19 having an opening percentage of 59% and a thickness of 1 mm is mounted with a height rising vertically up to the upper end of the gas-liquid separation chamber. Holes 15 in the anode side gas-liquid separation chamber are in an elliptical shape 5 mm wide and 22 mm long and are arranged at a 37.5-mm pitch.

The baffle plate 9 is provided only on the anode side. A titanium baffle plate with a thickness of 1 mm and a height H2 of 500 mm is installed, with a width W2 of a passage D set to 10 mm and a gap W2' between the separation wall 5 and the lower end of the plate set to 3 mm. A vertical distance S from the upper end of the baffle plate to the upper end of the electrode chamber is set to 40 mm.

The anode liquid distributor 14 comprises a square pipe having a length of 220 cm and a cross-sectional area of 4 cm$^2$, which is formed with 24 holes at equal intervals, each measuring 1.5 mm across, and which is installed horizontally at a position 50 mm above the bottom of the anode chamber of the cell, with one end joined to an anode side inlet nozzle 12. A pressure loss of this distributor was about 2 mm-$H_2O$ when saturated salt water of 150 L/Hr equivalent to 4 kA/m$^2$ was supplied.

A cathode liquid distributor 23 comprises a square pipe having a length of 220 cm and a cross-sectional area of 3.5 cm$^2$, which is formed with 24 holes at equal intervals, each measuring 2 mm across, and which is mounted horizontally at a position 50 mm above the bottom of the cathode chamber of the cell, with one end joined to a cathode side inlet nozzle. A pressure loss of this distributor was about 12 mm-$H_2O$ when alkali of 300 L/Hr equivalent to 4 kA/m$^2$ was supplied.

As a zero-gap structure on the cathode side, a structure shown in FIG. 1 was manufactured. More specifically, the conductive plate 3 is a nickel expanded metal having a thickness of 1.2 mm thick, with openings each measuring 8 mm in lateral length and 5 mm in longitudinal length. The cushion mat 2 has four nickel wires of a 0.1 mm diameter, which are woven into a mat and then corrugated to a thickness of 9 mm. This mat is secured to the conductive plate 3 by spot-welding at 18 locations. The mat is then covered with a 40 mesh nickel wire net of a 0.15-mm wire diameter, which is coated with a material mainly composed of ruthenium oxide to a thickness of about 3 μm and forms the hydrogen generating cathode 1. The hydrogen generating cathode 1 is secured to the conductive plate 3 by spot-welding at about 60 locations along the periphery of the cathode. The cathode side zero-gap structure is thus constructed of three layers.

The anode side structure has the anode liquid distributor 14 as shown in FIG. 3 and the baffle plate 9 as shown in FIG. 3 and FIG. 4.

To prevent pressure variations in the cell, the partition plate 20 and the bubble eliminating porous plate 19, shown in FIG. 5, are provided in the anode side gas-liquid separation chamber. They are not provided in the cathode side gas-liquid separation chamber.

The anode 11 is a titanium plate of a 1 mm thickness, which is expanded, roll-pressed to a thickness of 1±0.05 mm and secured to ribs 22. The opening portions of the expanded metal before being roll-pressed are at a pitch of 6 mm in horizontal direction and 3 mm in longitudinal direction with a machining pitch is set to 1 mm. The opening percentage of the expanded metal after roll-pressing was measured by a copying machine and found to be 40%. The expanded metal was etched with sulfuric acid, and the maximum height difference between the ridges and troughs (the irregularities) on the surface was 30 μm. The base material is etched with acid and then coated with a material mainly composed of $RuO_2$, $IrO_2$ and $TiO_2$ to form the anode. The maximum height difference between the ridges and troughs (the irregularities) on the anode surface after the coating was about 13 μm.

The maximum height difference between the irregularities on the anode surface was measured by using the New-View5022 scanner from Zygo.

First, a calibration was performed using a standard sample where the irregularities were set to 1.824 μm so that an appropriate amount of light could be obtained. Then, a target object was put under a white light source and an adjustment was made to cause interference fringes to appear. Then, a measurement was taken of the interference fringes as the object was moved about 100 μm vertically, the irregularities were determined by a frequency area analysis, and a difference between the maximum and minimum values was calculated to be a maximum difference between the ridges and the troughs (the irregularities).

A cationic exchange membrane ACIPLEX® F4401 was sandwiched between the electrolytic cells of the above construction through gaskets to form the electrolyzer. Salt water with a concentration of 300 g/L was supplied as an anode liquid to the anode chamber side of this electrolyzer so that an outlet salt water concentration would be 200 g/L. Lean caustic soda was supplied to the cathode chamber side so that an outlet caustic soda concentration would be 32% by weight. An electrolysis operation was performed for 360 days at an electrolysis temperature of 90° C., an absolute pressure of 0.14 MPa during electrolysis and a current density of 4-6 kA/$m^2$.

The anode liquid concentration distribution and the cathode liquid density distribution in the electrolytic cell during the electrolysis operation were measured at the sampling points 13 shown in FIG. 3 and FIG. 8. More specifically, the measurement was taken at nine points which were 150 mm, 600 mm and 1000 mm below the top of the conducting portion in the cell and at the center of the cell and 100 mm inside from the both ends of the cell. Differences between the maximum and minimum concentrations at the nine points are shown as concentration difference in Table 1.

TABLE 1

| | Application example 1 | | | |
|---|---|---|---|---|
| | 5 kA/$m^2$ | | 6 kA/$m^2$ | |
| | First 30 days | 300-360 days | First 30 days | 300-360 days |
| Average voltage (V) | 2.90 | 2.92 | 2.99 | 3.02 |
| Voltage change (mV) | 20 | | 30 | |
| Average current efficiency (%) | 96.7 | 96.0 | 96.5 | 95.5 |
| Current efficiency change (%) | 0.7 | | 1.0 | |
| Volume of salt water supplied (L/Hr-cell) | 193 | | 232 | |
| Volume of lean salt water recycled | 25 (L/Hr-cell) | | 25 (L/Hr-cell) | |
| In-cell salt water concentration difference (N) | 0.31 | | 0.35 | |
| NaOH supply volume (L/Hr-cell) | 300 | | 300 | |
| Concentration of supplied NaOH (%) | 30.4 | | 30.6 | |
| In-cell NaOH concentration difference (%) | 0.6 | | 0.8 | |
| Anode side in-cell pressure variation | Less than 5 (cm-$H_2O$) | | Less than 5 (cm-$H_2O$) | |
| State of ion exchange membranes after 360 days | No pin holes or bubbles were observed on ion exchange membranes. | | | |

Further, Table 1 shows measurement of the average voltage and voltage change, current efficiency, and vibrations and concentration distribution in the cells during the electrolysis operation. Table 1 shows that a voltage rise was as small as 30 mV for 6 kA/$m^2$ and that current efficiency degradation was also as small as 1%. Vibrations in the electrolytic cell were less than 5 cm in the water column and the concentration difference was 0.31-0.35 N on the anode side and 0.6-0.8% on the cathode side.

After 360 days of the electrolysis operation, the electrolyzer was disassembled to take out the ion exchange membranes for examination. The ion exchange membranes had no bubbles and were in a good state for future use and operation.

COMPARISON EXAMPLE 1

An electrolyzer was manufactured by using similar bipolar electrolytic cells except that the anodes used in the application example 1 were modified.

More specifically, the titanium plate of a 1 mm thickness of the anode was expanded to have an opening percentage of 30% and then etched with sulfuric acid to form irregularities on its surface whose maximum height difference was about 8 μm. The expanded titanium plate was then coated with a material composed mainly of $RuO_2$, $IrO_2$ and $TiO_2$. The maximum height difference between the irregularities on the coated surface was 3 μm and the thickness of the anode was 1.8 mm. This electrolyzer was operated under exactly the same conditions as application example 1 and a similar measurement was made. Measured values are shown in Table 2. Table 2 shows that a voltage rise was as high as 150 mV for 6 kA/$m^2$ and current efficiency reduction was as large as 2-3%. Vibrations in the electrolytic cell were less than 5 cm in the water column for 6 kA/$m^2$ and a concentration difference was 0.31-0.35 N on the anode side and 0.6-0.8% on the cathode side.

After the 360 days operation, the electrolyzer was disassembled to take out the ion exchange membranes for examination. The ion exchange membranes were found to have fine bubbles and some were formed with small pin holes.

REFERENCE EXAMPLE 1

An electrolyzer was built by using similar bipolar electrolytic cells except that the hydrogen generating cathodes used in application example 1 were modified. Used as the hydrogen generating cathode was a 14 mesh nickel wire net of a 0.4 mm wire diameter (a cathode thickness of 0.8 mm) coated with a material composed mainly of nickel oxide to a thickness of about 250 μm.

After the electrolyzer was operated under exactly the same conditions as the application example 1, similar measurements were made. The results are shown in Table 2. The results show that voltage was relatively high from the initial stage, that its rise was as large as 80 mV for 6 kA/$m^2$ and that the current efficiency degradation was as great as 2-3%. Vibrations in the electrolytic cell were less than 5 cm in the water column for 6 kA/$m^2$ and a concentration difference was 0.31-0.35 N on the anode side and 0.6-0.8% on the cathode side.

After 360 days of the operation, the electrolyzer was disassembled to take out the ion exchange membranes for examination. The surface of the ion exchange membranes were scraped off. Some were formed with small pin holes. The cathode coating was heavily scraped and cracked.

TABLE 2

| | Comparison example 1 | | | | Reference example 1 | |
|---|---|---|---|---|---|---|
| | 5 kA/$m^2$ | | 6 kA/$m^2$ | | 6 kA/$m^2$ | |
| | First 30 days | 300-360 days | First 30 days | 300-360 days | First 30 days | 300-360 days |
| Average voltage (V) | 2.95 | 3.08 | 3.05 | 3.20 | 3.04 | 3.12 |
| Voltage change (mV) | 130 | | 150 | | 80 | |
| Average current efficiency (%) | 96.3 | 93.8 | 96.1 | 93.5 | 96.1 | 93.3 |
| Current efficiency change (%) | 2.5 | | 2.6 | | 2.8 | |
| Volume of salt water supplied (L/Hr-cell) | 193 | | 232 | | 232 | |
| Volume of lean salt water recycled | 25 (L/Hr-cell) | | 25 (L/Hr-cell) | | 25 (L/Hr-cell) | |
| In-cell salt water concentration difference (N) | 0.31 | | 0.35 | | 0.35 | |
| NaOH supply volume (L/Hr-cell) | 300 | | 300 | | 300 | |
| Concentration of supplied NaOH (%) | 30.5 | | 30.5 | | 30.5 | |
| In-cell NaOH concentration difference (%) | 0.6 | | 0.8 | | 0.8 | |

TABLE 2-continued

| | Comparison example 1 | | | | Reference example 1 | |
|---|---|---|---|---|---|---|
| | 5 kA/$m^2$ | | 6 kA/$m^2$ | | 6 kA/$m^2$ | |
| | First 30 days | 300-360 days | First 30 days | 300-360 days | First 30 days | 300-360 days |
| Anode side in-cell pressure variation | Less than 5 (cm-$H_2O$) | | Less than 5 (cm-$H_2O$) | | Less than 5 (cm-$H_2O$) | |
| State of ion exchange membranes after 360 days | Almost all ion exchange membranes were found with bubbles; some had pin holes | | | | Many ion exchange membrane surfaces were damaged and pin-holed. | |

APPLICATION EXAMPLE 2

An electrolyzer was built by using similar bipolar electrolytic cells except that the anodes used in application example 1 were modified.

A titanium plate of 1 mm thickness was used as the anode and the titanium plate was expanded and roll-pressed to a thickness of 1.2 mm. An opening percentage was measured to be 40%. The expanded titanium plate was etched with sulfuric acid to form irregularities on its surface whose maximum height difference was about 30 μm. It was then coated with a material composed mainly of $RuO_2$, $IrO_2$ and $TiO_2$. The maximum height difference between the irregularities on the coated surface was 13 μm. The electrolyzer was operated under exactly the same conditions as application example 1 and a similar measurement was made. Measured values are shown in Table 3. Table 3 shows that a voltage rise was 50 mV for 6 kA/$m^2$ and current efficiency degradation was 1.3%. Vibrations in the electrolytic cell were less than 5 cm in the water column for 6 kA/$m^2$ and a concentration difference was 0.31-0.36 N on the anode side and 0.6-0.8% on the cathode side.

After 360 days of the electrolysis operation, the electrolyzer was disassembled to take out the ion exchange membranes for examination. The ion exchange membranes had no bubbles and were in a good state for future use and operation.

TABLE 3

| | Application example 2 | | | |
|---|---|---|---|---|
| | 5 kA/$m^2$ | | 6 kA/$m^2$ | |
| | First 30 days | 300-360 days | First 30 days | 300-360 days |
| Average voltage (V) | 2.93 | 2.96 | 3.02 | 3.07 |
| Voltage change (mV) | 30 | | 50 | |
| Average current efficiency (%) | 96.7 | 95.8 | 96.5 | 95.2 |
| Current efficiency change (%) | 0.9 | | 1.3 | |
| Volume of salt water supplied (L/Hr-cell) | 193 | | 232 | |

TABLE 3-continued

| | Application example 2 | | | |
|---|---|---|---|---|
| | 5 kA/m$^2$ | | 6 kA/m$^2$ | |
| | First 30 days | 300-360 days | First 30 days | 300-360 days |
| Volume of lean salt water recycled | 25 (L/Hr-cell) | | 25 (L/Hr-cell) | |
| In-cell salt water concentration difference (N) | 0.31 | | 0.36 | |
| NaOH supply volume (L/Hr-cell) | 300 | | 300 | |
| Concentration of supplied NaOH (%) | 30.4 | | 30.6 | |
| In-cell NaOH concentration difference (%) | 0.6 | | 0.8 | |
| Anode side in-cell pressure variation | Less than 5 (cm-$H_2O$) | | Less than 5 (cm-$H_2O$) | |
| State of ion exchange membranes after 360 days | No pin holes or bubbles were observed on ion exchange membranes. | | | |

APPLICATION EXAMPLE 3

Electrolysis was performed in a range of 7-8 kA/m$^2$ using the same electrolyzer as in application example 1.

In this operation, lean brine discharged when the anode liquid from the electrolyzer was added in a maximum volume of 155 L/Hr-cell to the saturated salt water and supplied each electrolytic cell a desired concentration distribution. For the cathode liquid also, a supply volume was changed up to 400 L/Hr-cell to keep desired concentration distribution.

Voltage, current efficiency, and vibrations and concentration distribution in the cells during the electrolysis operation were measured. The results are shown in Table 4. Table 4 shows that a voltage rise was as small as 30 mV for 8 kA/m$^2$ and that the current efficiency degradation was as small as 0.9%. Vibrations in the cell were less than 10 cm in water column and a concentration difference was 0.39-0.47 N on the anode side and 1.2-1.4% on the cathode side.

After 180 days of the electrolysis operation, the electrolyzer was disassembled to take out the ion exchange membranes for examination. The ion exchange membranes had no bubbles and were in a good state for future use and operation.

REFERENCE EXAMPLE 2

Electrolysis was performed in a range of 7-8 kA/m$^2$ using exactly the same electrolyzer as application example 1.

The electrolysis was conducted under similar conditions to those of application example 3, except that the lean brine discharged from the electrolyzer as the anode liquid was not added to the saturated brine and the supply volume of cathode liquid was kept at 300 L/Hr-cell.

Voltage, current efficiency, and vibrations and concentration distribution in the cells during the electrolysis operation were measured and the results are shown in Table 4. The result shows that a voltage rise was 90 mV for 8 kA/m$^2$ and that the current efficiency degradation was 3.3%. Vibrations in the cell were less than 5 cm in water column and a concentration difference was 0.6-0.7 N on the anode side and 1.5-2.1% on the cathode side.

After 180 days of the electrolysis operation, the electrolyzer was disassembled to take out the ion exchange membranes for examination. The ion exchange membranes had many bubbles measuring 1-10 mm in diameter adhering to their entire surfaces.

TABLE 4

| | Application example 3 | | | | Reference example 2 | | | |
|---|---|---|---|---|---|---|---|---|
| | 7 kA/m$^2$ | | 8 kA/m$^2$ | | 7 kA/m$^2$ | | 8 kA/m$^2$ | |
| | First 30 days | 150-180 days | First 30 days | 150-180 days | First 30 days | 150-180 days | First 30 days | 150-180 days |
| Average voltage (V) | 3.09 | 3.11 | 3.18 | 3.21 | 3.08 | 3.16 | 3.17 | 3.26 |
| Voltage change (mV) | 20 | | 30 | | 80 | | 90 | |
| Average current efficiency (%) | 96.3 | 95.5 | 96.1 | 95.2 | 96.1 | 92.9 | 96.0 | 92.7 |
| Current efficiency change (%) | 0.8 | | 0.9 | | 3.2 | | 3.3 | |
| Volume of salt water supplied (L/Hr-cell) | 337 | | 465 | | 270 | | 310 | |
| Volume of lean salt water recycled | 67 (L/Hr-cell) | | 155 (L/Hr-cell) | | 25 (L/Hr-cell) | | 25 (L/Hr-cell) | |
| In-cell salt water concentration difference (N) | 0.39 | | 0.47 | | 0.61 | | 0.73 | |
| NaOH supply volume (L/Hr-cell) | 350 | | 400 | | 300 | | 300 | |
| Concentration of supplied NaOH (%) | 30.5 | | 30.5 | | 30.5 | | 30.5 | |
| In-cell NaOH concentration difference (%) | 1.2 | | 1.4 | | 1.5 | | 2.1 | |
| Anode side in-cell pressure variation | 8 (cm-$H_2O$) | | 8 (cm-$H_2O$) | | Less than 5 (cm-$H_2O$) | | Less than 5 (cm-$H_2O$) | |
| State of ion exchange membranes after 360 days | No abnormalities were found in ion exchange membranes. | | | | Many bubbles were observed. | | | |

APPLICATION EXAMPLE 4

Figure 9:
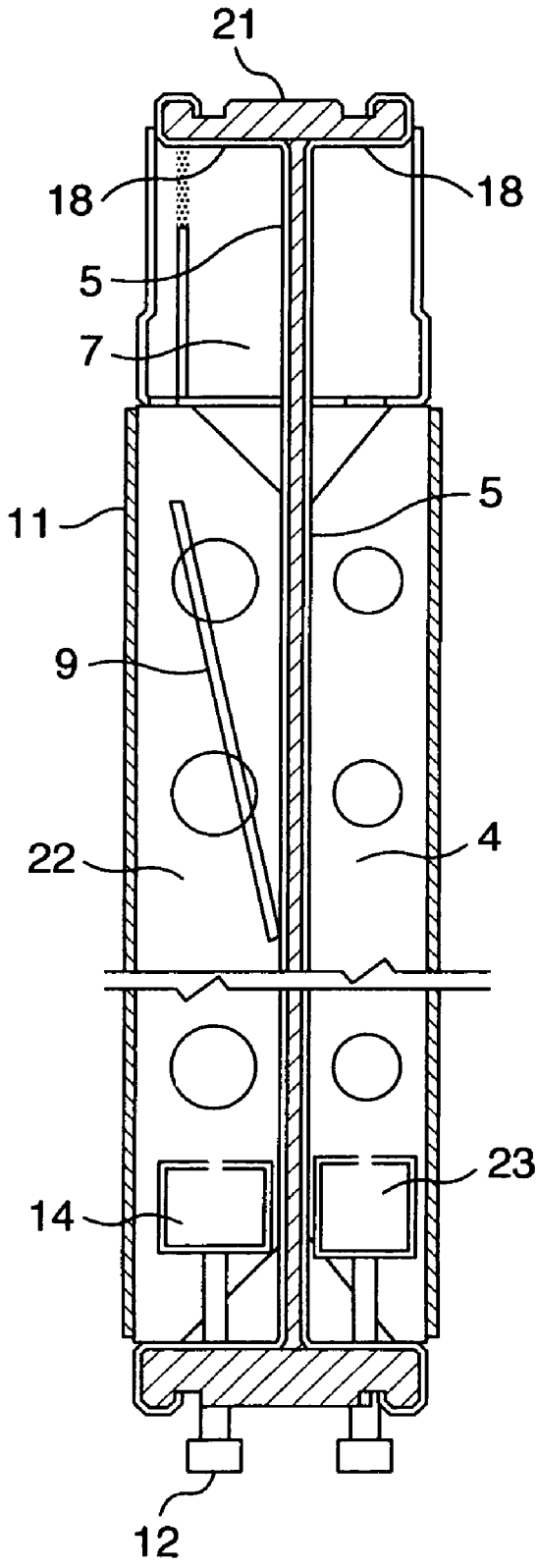
FIG. 9 is a sectional view showing the bipolar, finite-gap type electrolytic cell according to another embodiment of the invention.

A bipolar electrolytic cell was prepared with a cross-sectional structure as shown in FIG. 9, an expanded metal of a 1.8 mm thickness as the anode and a nickel expanded metal as the cathode. The cathode is coated with a material composed mainly of nickel oxide by plasma spraying to a thickness of 250 μm. The electrolytic cell was used for one year with the electrode distance set to 2 mm.

The anode of this cell was taken out and a new anode with the exact configuration of application example 1 was installed in its place. Further, the coating on the cathode was scraped off by a brush to expose a nickel base metal to be used as a conductive plate. The same cushion mat and hydrogen generating cathode as those of application example 1 were mounted in exactly the same way.

An electrolyzer similar to that of application example 1 was built. Electrolysis was then performed in a similar manner. Voltage, current efficiency, and vibrations and the concentration distribution in the cells during the electrolysis operation were measured. The results are shown in Table 5. Table 5 shows that a voltage rise was only 20 mV for 6 $kA/m^2$ and that the current efficiency degradation was as small as 0.7%. Vibrations in the cell were less than 5 cm in water column and a concentration difference was 0.35 N at maximum on the anode side and 0.8% at maximum on the cathode side.

After 180 days of the electrolysis operation, the electrolyzer was disassembled to take out the ion exchange membranes for examination. The ion exchange membranes had no bubbles and were in a good state good for future use and operation.

TABLE 5

| | Application example 4 | | | |
|---|---|---|---|---|
| | 5 $kA/m^2$ | | 6 $kA/m^2$ | |
| | First 30 days | 150-180 days | First 30 days | 150-180 days |
| Average voltage (V) | 2.91 | 2.92 | 3.00 | 3.02 |
| Voltage change (mV) | 10 | | 20 | |
| Average current efficiency (%) | 96.8 | 96.2 | 96.6 | 95.9 |
| Current efficiency change (%) | 0.6 | | 0.7 | |
| Volume of salt water supplied (L/Hr-cell) | 193 | | 232 | |
| Volume of lean salt water recycled | 25 (L/Hr-cell) | | 25 (L/Hr-cell) | |
| In-cell salt water concentration difference (N) | 0.32 | | 0.35 | |
| NaOH supply volume (L/Hr-cell) | 300 | | 300 | |
| Concentration of supplied NaOH (%) | 30.5 | | 30.5 | |
| In-cell NaOH concentration difference (%) | 0.6 | | 0.8 | |
| Anode side in-cell pressure variation | Less than 5 (cm-$H_2O$) | | Less than 5 (cm-$H_2O$) | |
| State of ion exchange membranes after 360 days | No pin holes or bubbles were observed on ion exchange membranes. | | | |

INDUSTRIAL APPLICABILITY

The bipolar, zero-gap type electrolytic cell has the gas-liquid separation chambers 7 in non-conducting portions in upper parts of the anode and cathode chambers, each of which is formed integrally with the anode chamber or the cathode chamber, at least one cylindrical duct or baffle plate 9 is installed between a separation wall 5 of the anode chamber and/or cathode chamber and the electrodes to form an internal circulation path for the electrolyte, and three-layers on the cathode side, which comprise a conductive plate 3, a conductive cushion mat 2 stacked on the conductive plate, and a hydrogen generating cathode 1 placed on the cushion mat in an area where it contacts a cationic exchange membrane. In this bipolar, zero-gap type electrolytic cell, since the anode is optimally shaped, performing electrolysis at a current density of 4-8 $kA/m^2$ does not cause the voltage to rise as time elapses. Only a small reduction in the current efficiency occurs and it produces bubbles in the ion exchange membranes. With this, stable electrolysis can be performed for a long period of time.

Such a zero-gap electrolytic cell can also be manufactured by modifying those electrolytic cells using a finite gap structure. This modification of the finite gap cell into a zero-gap cell can be done for those electrolytic cells that have been used as finite gap cells and comprise gas-liquid separation chambers formed in non-conducting portions in upper parts of the anode and cathode chambers. The electrolytic cells form within the anode chamber or the cathode chamber. A cylindrical duct or baffle plate is installed between a separation wall of the anode chamber and/or cathode chamber in order for the electrodes to form an internal circulation path for the electrolyte. In this case, the anode and the anode chamber are modified into the structure described above, and then the cathode chamber is also modified. A conductive plate, a cushion mat and a cathode are then installed to form a zero-gap cell structure. A zero-gap electrolytic cell can also be manufactured simply by using the cathode that has been used in the finite gap cell as the conductive plate. Then, a cushion mat and a cathode are newly stacked on the conductive plate. Conversely, the zero-gap cell can be used as a finite gap cell by removing the cathode, the cushion mat and the conductive plate from the zero-gap cell and then by installing a new cathode. This modification is less expensive than manufacturing a new electrolytic cell and can be implemented easily, so it offers a great advantage for the user.

The invention claimed is:

1. A bipolar, zero-gap type electrolytic cell for use in a filter press type electrolyzer having a plurality of bipolar electrolytic cells and a plurality of anodic ion exchange membranes each arranged between adjacent bipolar electrolytic cells, comprising:

an anode chamber;

an anode provided in the anode chamber, said anode being formed of an anode base material comprising one of a titanium expanded metal and a titanium wire netting with an open area percentage of 25% to 75%, said anode, after being applied with a catalyst on the anode base material, having a maximum height difference of 5 μm to 50 μm between irregularities on a surface thereof and a thickness of 0.7 mm to 2.0 mm;

a cathode chamber arranged back to back with the anode chamber; and a cathode having at least two layers stacked in the cathode chamber, said layers including a conductive cushion mat layer and a layer of a hydrogen generating cathode, said hydrogen generating cathode layer being adjacent to the cushion mat layer and arranged in an area for contact with the anodic ion exchange membrane.

2. A bipolar, zero-gap type electrolytic cell according to claim 1, wherein said anode base material comprises the titanium expanded metal that is formed during the expansion and rolling process of a titanium plate.

3. A bipolar, zero-gap type electrolytic cell according to claim 2, wherein the metal has a thickness after the expansion and rolling process of 95% to 105% of a plate thickness before the expansion process.

4. A bipolar, zero-gap type electrolytic cell according to any one of claims 1 to 3, wherein said hydrogen generating cathode is formed of a base material having a thickness of 0.05 mm to 0.5 mm and is selected from a group of a nickel wire netting, an expanded nickel metal and a punched, porous nickel plate, and said hydrogen generating cathode has an electrolytic catalyst coating layer formed thereon that has a thickness of 50 μm or less.

5. A bipolar, zero-gap type electrolytic cell according to claim 1, further comprising gas-liquid separation chambers, said gas-liquid separation chambers being respectively formed in non-current-carrying parts at the top of the anode and cathode chambers within the anode and cathode chambers, wherein at least one of a cylindrical duct and a baffle plate serve as an inner circulation path for an electrolyte that is provided between at least one partition wall portion of the anode and cathode chambers which form the associated electrode.

6. A bipolar, zero-gap type electrolytic cell according to claim 5, wherein said gas-liquid separation chambers are formed with partition plates therein.

* * * * *

UNITED STATES PATENT AND TRADEMARK OFFICE

CERTIFICATE OF CORRECTION

PATENT NO. : 7,323,090 B2
APPLICATION NO. : 10/535249
DATED : January 29, 2008
INVENTOR(S) : Hiroyoshi Houda et al.

It is certified that error appears in the above-identified patent and that said Letters Patent is hereby corrected as shown below:

Title Page, Item (54) (Title), Line 1, after "BIPOLAR" insert --,--.

Column 1, Line 1, after "BIPOLAR" insert --,--.

Signed and Sealed this

Fifteenth Day of July, 2008

JON W. DUDAS
*Director of the United States Patent and Trademark Office*